US008806807B2

(12) United States Patent
Rees

(10) Patent No.: US 8,806,807 B2
(45) Date of Patent: Aug. 19, 2014

(54) SLIDING DOOR STRUCTURE HAVING SLIDING DOORS AND PIVOTING DOORS

(76) Inventor: Alan Rees, Oceanside, CA (US)

( * ) Notice: Subject to any disclaimer, the term of this patent is extended or adjusted under 35 U.S.C. 154(b) by 343 days.

(21) Appl. No.: 12/912,716

(22) Filed: Oct. 26, 2010

(65) Prior Publication Data

US 2011/0094161 A1 Apr. 28, 2011

Related U.S. Application Data

(60) Provisional application No. 61/279,862, filed on Oct. 26, 2009.

(51) Int. Cl.
*E05D 15/58* (2006.01)

(52) U.S. Cl.
USPC ..... 49/257; 49/130; 49/158; 49/177; 49/254; 49/410; 49/425

(58) Field of Classification Search
USPC ..... 49/409, 410, 411, 61, 63, 67, 125, 128, 49/127, 129, 130, 142, 143, 149, 158, 163, 49/168, 176, 177, 254, 257, 258, 260, 425
See application file for complete search history.

(56) References Cited

U.S. PATENT DOCUMENTS 2,386,510 A * 10/1945 Shafer ..... 49/409
3,027,606 A * 4/1962 Nicklas ..... 49/260
3,300,897 A * 1/1967 Wikkerink ..... 49/137
3,303,612 A * 2/1967 Baker ..... 49/127
4,702,506 A * 10/1987 Iimura ..... 292/251.5
2005/0284024 A1* 12/2005 Bjorkman et al. ..... 49/176

* cited by examiner

*Primary Examiner* — Katherine Mitchell
*Assistant Examiner* — Catherine A Kelly
(74) *Attorney, Agent, or Firm* — John R. Ross; John R. Ross, III

(57) ABSTRACT

A sliding panel structure. The sliding panel structure includes a frame having an upper support track and a lower guide rail. At least one sliding panel is connected between the upper support track and the lower guide rail. The sliding panel includes a sliding panel pivot axis and an extension for riding in the lower guide rail. The extension prevents undesired pivoting of the sliding panel about the sliding panel pivot axis. A mutual attraction device is connected between the sliding panel and the frame with a first mutual attraction part connected to the frame and the second mutual attraction part connected to the sliding panel. A fulcrum is utilized for tilting the sliding panel whenever the first mutual attraction part engages the second mutual attraction part. The tilting of the sliding panel causes the extension to disengage the lower guide rail which allows the sliding panel to pivot about the sliding panel pivot axis. In a preferred embodiment the sliding panel structure includes at least one stationary pivoting panel. In another preferred embodiment the sliding panel is a plurality of sliding panels. In another preferred embodiment the sliding panel is a sliding door. In another preferred embodiment the sliding panel is a sliding window. In another preferred embodiment the mutual attraction device is utilizes magnetic force so that a magnet connected to the sliding panel is attracted to a magnet connected to the frame.

7 Claims, 19 Drawing Sheets

SLIDING DOOR STRUCTURE HAVING SLIDING DOORS AND PIVOTING DOORS

This application claims the benefit of Provisional Application No. 61/279,862 filed Oct. 26, 2009. The present invention relates to door panel structures, and in particular, to door panel structures having sliding doors and pivoting doors.

BACKGROUND OF THE INVENTION

Various types of track-suspended door structures are known. For example, U.S. Pat. No. 3,266,189 shows a typical power-operated arrangement. It is known to so arrange sliding doors that the doors can move not only in direction of a suspension track, for example in a straight line to and from each other, but additionally include panel members which are arranged for swinging movement transverse to the direction of sliding movement. Such additional swinging movement is desirable particularly in installations where a maximum panel opening is desired, for example to permit a large number of people to rapidly leave a building, or to provide an opening of increased width for vehicular traffic. Residential applications whereby the user desires maximum view and ventilation are also to be appreciated. However, sliding doors which are so arranged cause difficulties since swinging movement of the door panels or door elements of sliding doors does not permit attaching of hinges about which the doors can swing to a fixed frame. The attachment point for the hinges are movable and for swinging movement the doors can no longer be supported along their width from the top. For example, the hinge attachment on a sliding frame portion will shift, causing the door, as it swings, to bind against a floor structure. It is customary to provide sliding doors with a downwardly projecting guide element, typically a bolt, or the like, which slides in a guide track or rail. This bolt, however, is movable longitudinally in a sliding direction and will shift its position upon release of a swinging door element from the sliding door structure, so that it is suspended only on the hinges, due to the force moment which the door exerts on the hinge structure. It is undesirable to foreshorten the door so that the tilting of the door frame, upon swinging movement of the door, is compensated, since, then, when the door is closed, a gap will permit exchange of heated or cooled air, and otherwise interfere with the purposes of a door, which is to close off an opening.

U.S. Pat. No. 4,438,594 uses a massive metal angle element to provide a pre-stressing force and keep the door panel from binding with the floor structure ort to counteract the weight as the panels swing open. This type of counterweight would add considerably to the weight of the door and require more strength to push the panel open or closed. Massive counterweights require reinforcements in the building frame and door jamb to hold the additional weight. A massive counterweight would require heavy duty bogies, guide tracks, and pivot hinges to carry the weight. Shipping would also be more expensive due to the additional weight. Installation of the door panels would require more manpower to hold up the "massive counterweight" while installers secure the panels to the bogies. The added shipping weight, manufacturing cost and labor would be cost prohibitive.

U.S. Pat. No. 5,272,839 uses a toothed apparatus and hinge pins to eliminate friction and weight transfer. The '839 patent also suggests a wing shaped bracket to prevent the pane from tilting. Brackets springs, and toothed apparatus require precision manufacturing and highly trained installers because the panels would need to be aligned perfectly. Toothed apparatuses and wing shaped brackets can wear out easily with repeated use. These disadvantages would add to the cost of manufacturing and installation as well as allowing for more points of failure in the closure.

Bi-folds closure, which are known and have been around since the 1950's. The Nana bi-fold doors manufactured by NanaWall Systems, Inc. or the lanai bi-fold doors, manufactured by Lanai Doors Incorporated, require four to eight hinge mechanisms per panel to stabilize and transfer the weight of the attached open panels to the frame of the building. These many hinges keep the panels from binding against a floor structure. These hinge mechanisms require precise manufacturing and installation because many of the panels are attached together like a train and a failure at one hinge or wheeled carriage bogie effects all the attached panels rendering the door inoperable. With many parts that need to be manufactured and assembled precisely and difficult installation, the costs for these bi-fold closure systems tend to be in the high end or Luxury category. More hinges also create more failure points for these bi-fold closures. Bi-fold closures are limited in their width due to the fact that the more panels that are attached together, the heavier the closure becomes and the harder it is for the consumer to push open a multi panel bi-fold closure because they need to move all the attached weight.

What is needed is a better sliding door structure.

SUMMARY OF THE INVENTION

The present invention provides a sliding panel structure. The sliding panel structure includes a frame having an upper support track and a lower guide rail. At least one sliding panel is connected between the upper support track and the lower guide rail. The sliding panel includes a sliding panel pivot axis and an extension for riding in the lower guide rail. The extension prevents undesired pivoting of the sliding panel about the sliding panel pivot axis. A mutual attraction device is connected between the sliding panel and the frame with a first mutual attraction part connected to the frame and the second mutual attraction part connected to the sliding panel. A fulcrum is utilized for tilting the sliding panel whenever the first mutual attraction part engages the second mutual attraction part. The tilting of the sliding panel causes the extension to disengage the lower guide rail which allows the sliding panel to pivot about the sliding panel pivot axis. In a preferred embodiment the sliding panel structure includes at least one stationary pivoting panel. In another preferred embodiment the sliding panel is a plurality of sliding panels. In another preferred embodiment the sliding panel is a sliding door. In another preferred embodiment the sliding panel is a sliding window. In another preferred embodiment the mutual attraction device is utilizes magnetic force so that a magnet connected to the sliding panel is attracted to a magnet connected to the frame.

DETAILED DESCRIPTION OF THE PREFERRED EMBODIMENTS

Figure 1:
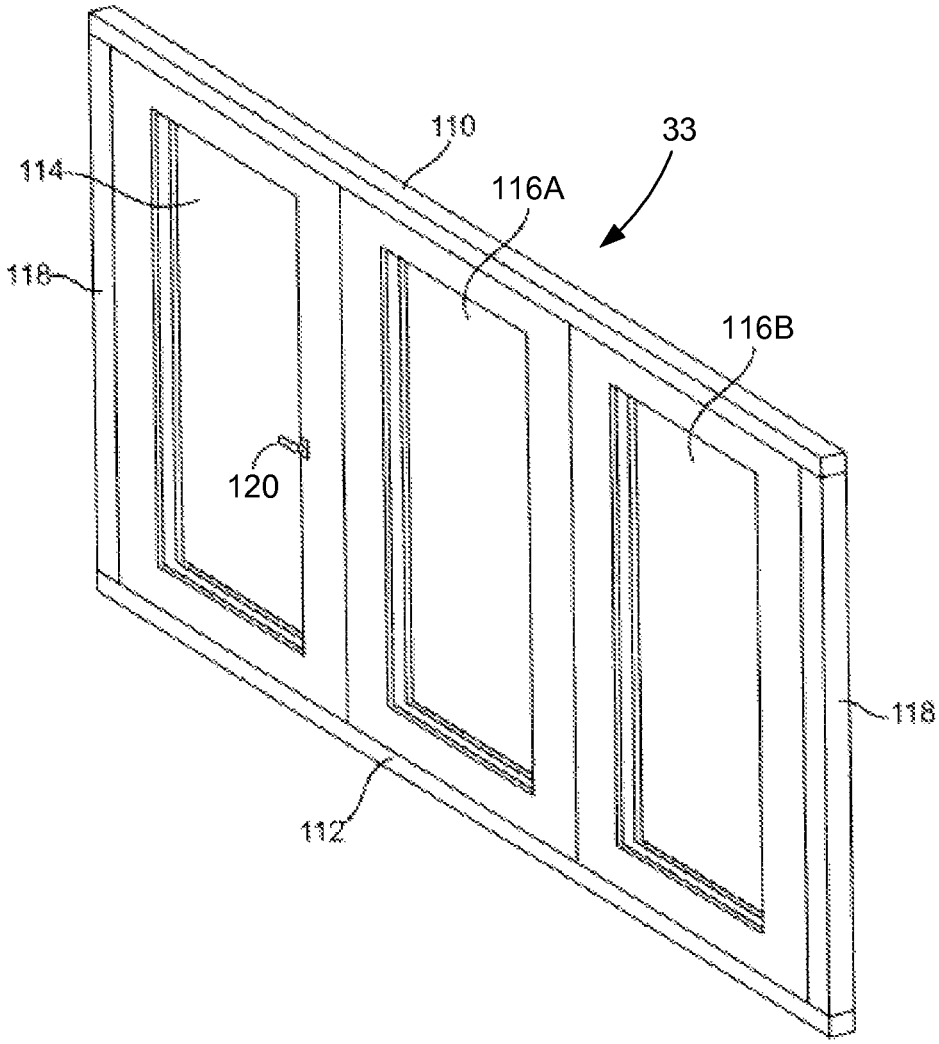
FIGS. 1-1D show a preferred embodiment of the present invention.
Figure 1A:
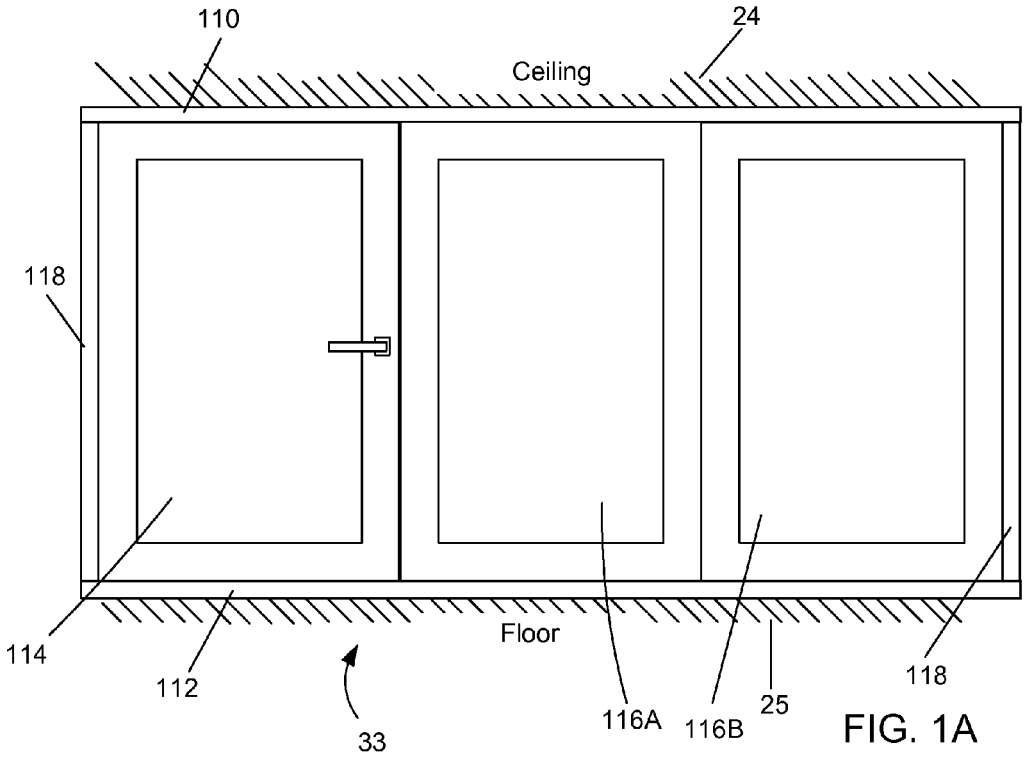

FIGS. 1 and 1A show a right prospective and front view of sliding door structure 33. Sliding door structure 33 is shown in the closed position and includes upper support track 110 and a lower guide rail 112. In a preferred embodiment both upper support track 110 and lower guide rail 112 are aluminum extrusions. Upper support track 110 is preferably fastened to ceiling 24 and a lower guide rail 112 is preferably attached to floor 25. Door jambs 118 are located as shown on both sides of sliding door structure 33. Sliding door structure 33 preferably includes one pivoting door 114 and two sliding doors 116A and 116B. The frames of doors 114, 116B and 116A are preferably constructed of aluminum extrusions. Also, preferably, panels 114 and 116 include an insulated glazing unit (not shown).

Figure 1B:
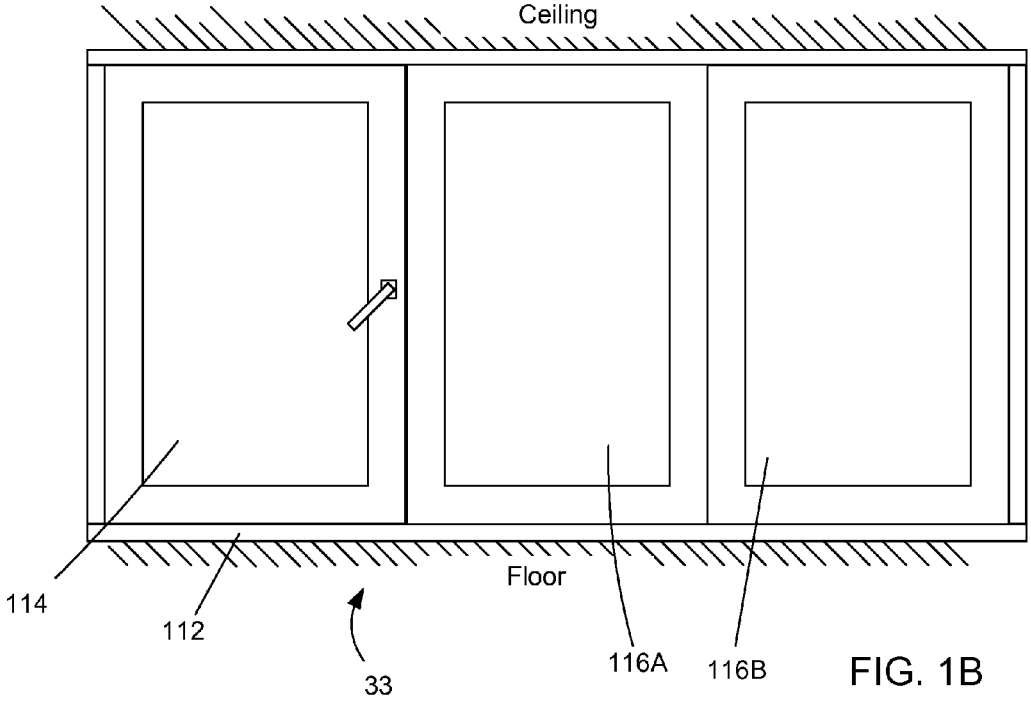
Figure 1C:
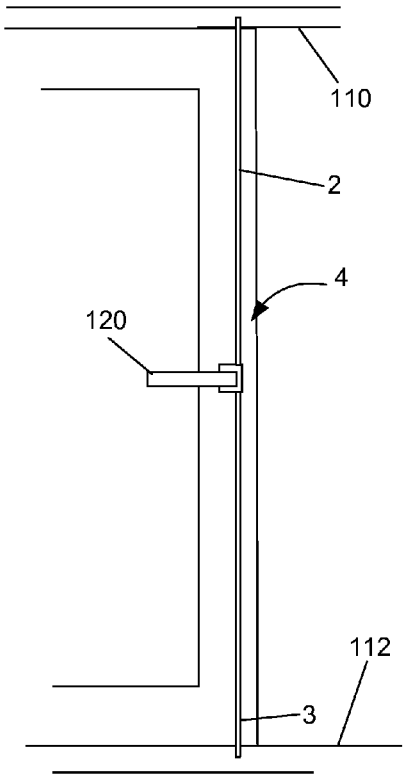
Figure 1D:
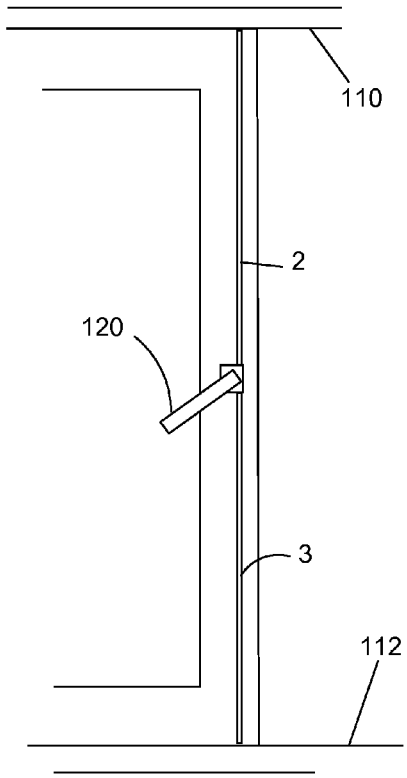

Sliding door structure 33 preferably utilizes dual point shoot bolt locking hardware 4 (FIG. 1C). Pivoting door 114 is secured in the position shown in FIGS. 1 and 1A by the extension of shoot bolt 2 into upper support track 110 and the extension of shoot bolt 3 into lower guide rail 112 (FIG. 1C). As the user turns handle 120 forty-five degrees (FIGS. 1B and 1D), shoot bolts 2 and 3 are retracted. This disengages door 114 from upper support track 110 and lower guide rail 112 so that the door can be easily opened.

Figure 2A:
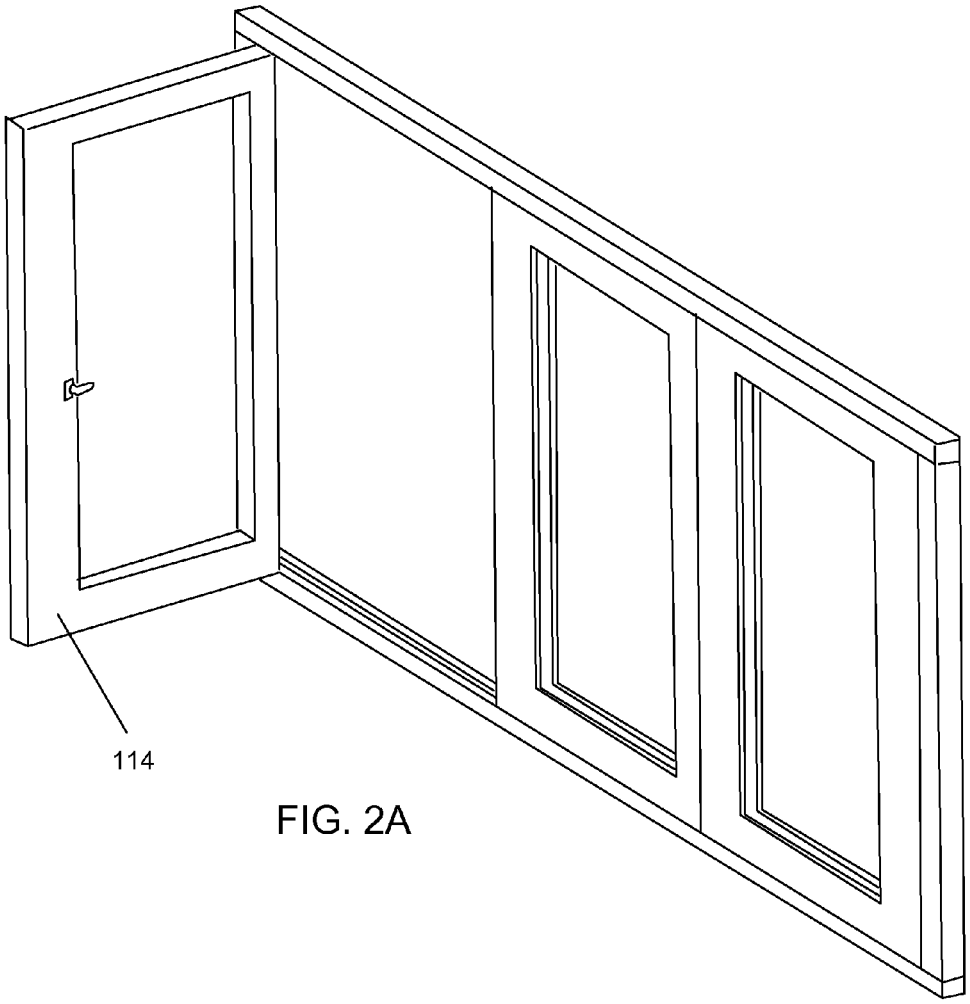
FIGS. 2A-2B show the stationary door opened.
Figure 2B:
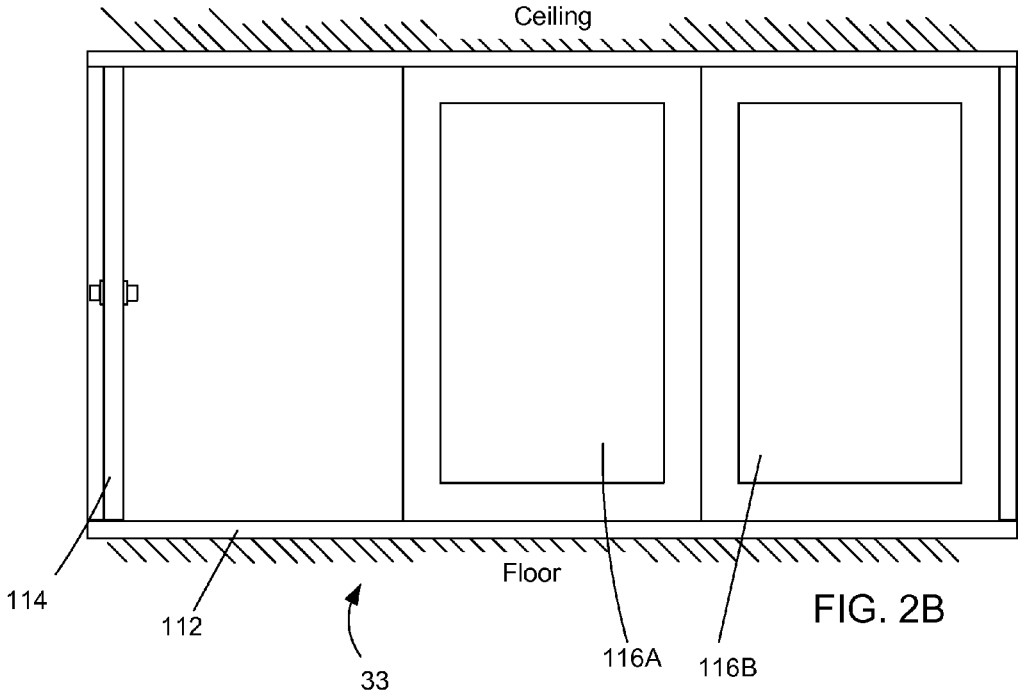
Figure 2C:
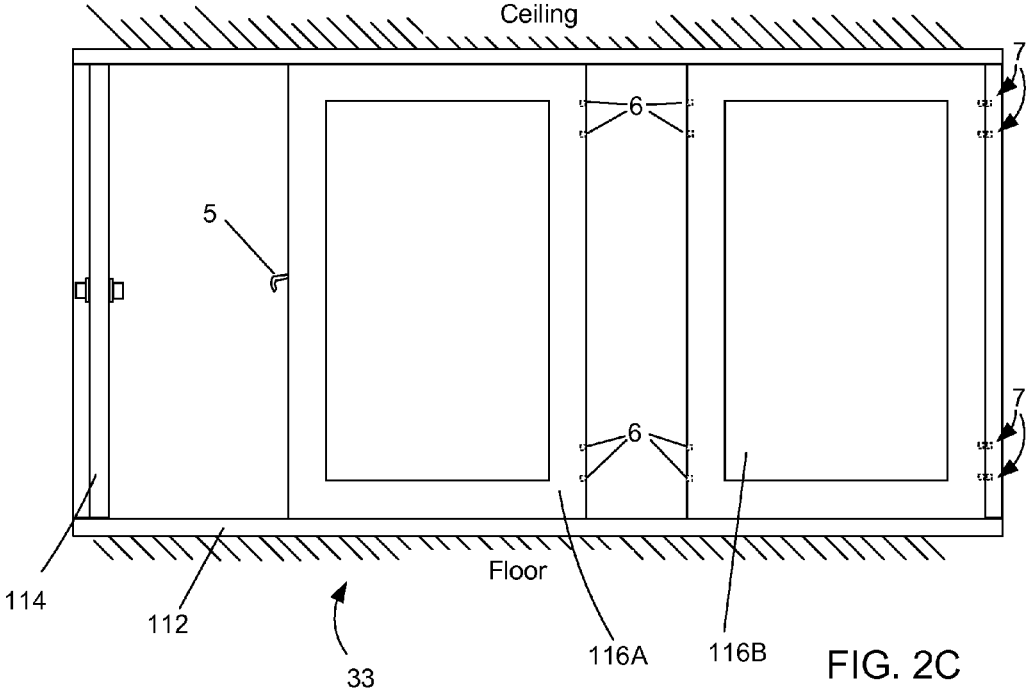
FIGS. 2C-2G show the sliding door moving towards the stationary door.

As shown in FIGS. 2A and 2B the user has pulled pivoting door 114 so that it has pivoted 90 degrees and is opened. In FIG. 2C the user has grabbed retractable handle 5 and has pulled sliding door 116A to the left with sufficient force to overcome the magnetic attraction of door magnets 6. In a preferred embodiment, the magnetic attraction force between magnets 7 is greater than the magnetic attraction force between magnets 6. Therefore, as the user pulls handle 5, door 116A moves leftward but door 116B remains in place.

Figure 2D:
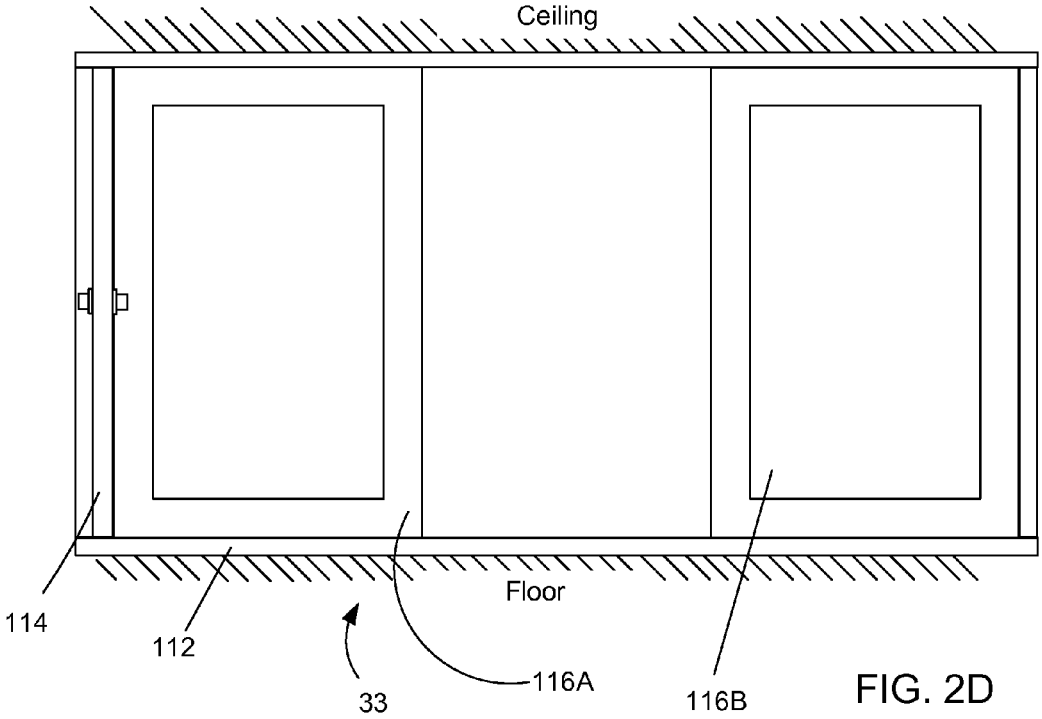
Figure 2E:
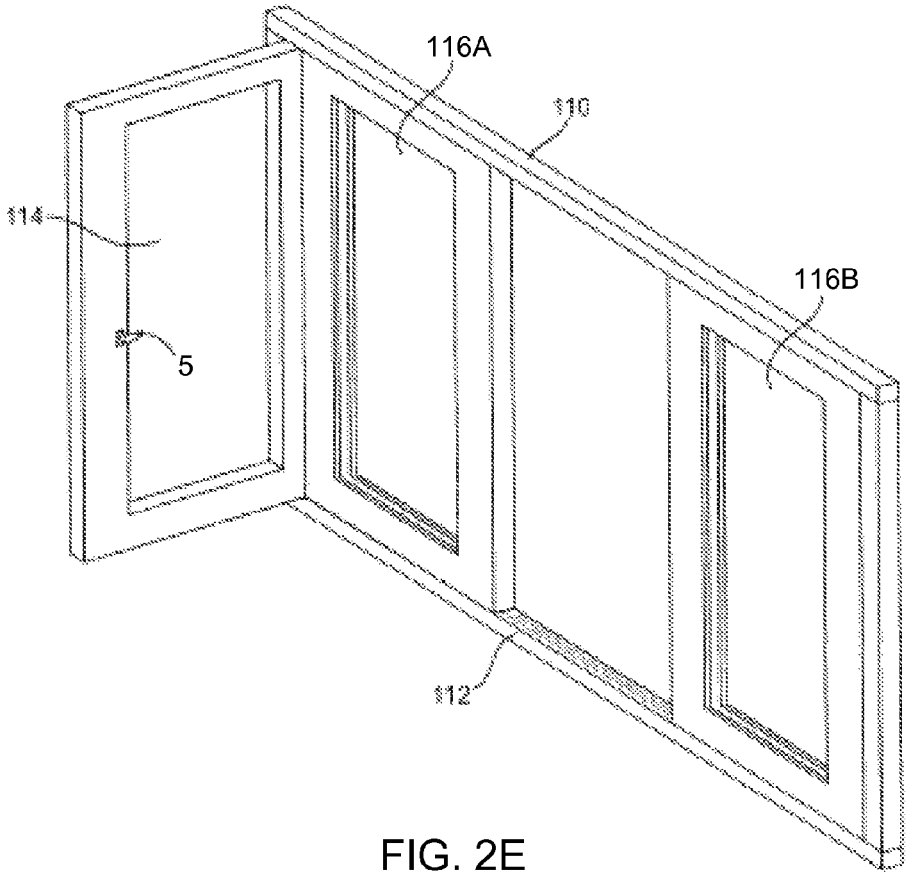
Figure 2F:
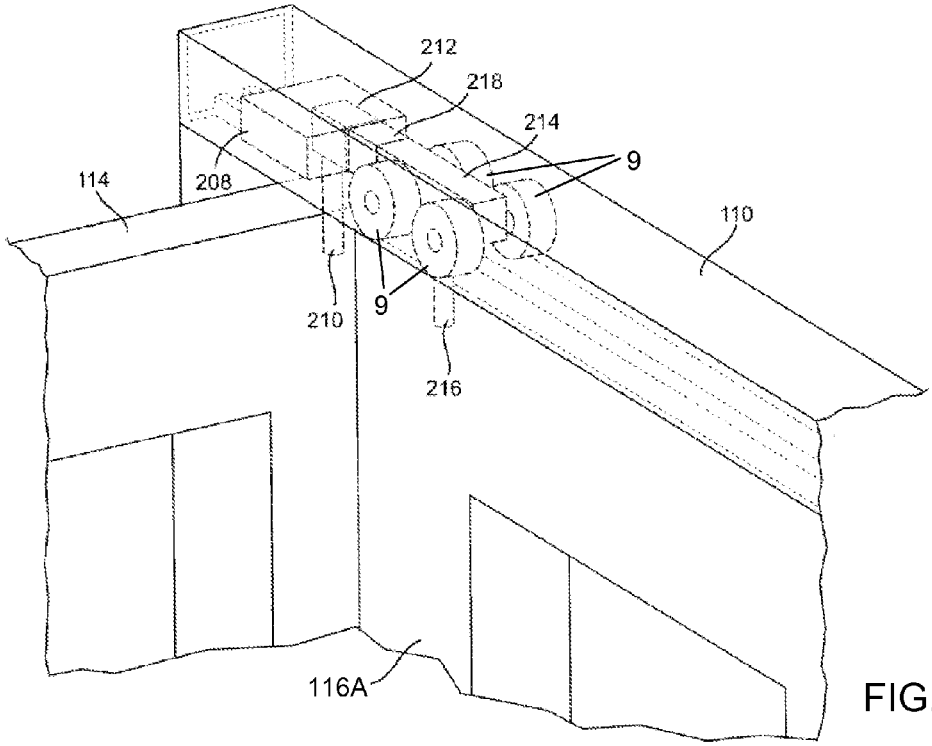

As shown in FIGS. 2D, 2E and 2F the user has pulled sliding door 116A all the way leftward. FIG. 2F shows a close up perspective view of the tops of pivoting door 114, sliding door 116A and upper support track 110.

As shown in FIG. 2F, upper pivot hinge 210 extends downward from stationary upper anchor 208. Stationary door magnet 212 is housed inside stationary upper anchor 208. Likewise, upper pivot hinge 216 extends downward from upper bogie 214. Sliding door magnet 218 is attached to upper bogie 214. Upper bogie 214 is supported by wheels 9. Wheels 9 are configured to roll inside upper support track 110, thereby allowing sliding door 116A to slide leftward and rightward.

As shown in FIG. 2F pivoting door 114 is pivoted 90 degrees open and sliding door 116A has been slid toward pivoting door 114 so as to engage stationary door magnet 212 with sliding door magnet 218. Preferably magnets of an industrial strength and quality are utilized.

FIG. 2F shows upper support track 110 having the approximate shape of an upside down "u" with flanges pointing inward toward the center and a grove running down the middle so that bogie 214 can run horizontally within upper support track 110. Pivoting door 114 is attached to stationary upper anchor 208 via fixed pivot hinge 210. Preferably, stationary upper anchor 208 is fabricated from aluminum.

Figure 2G:
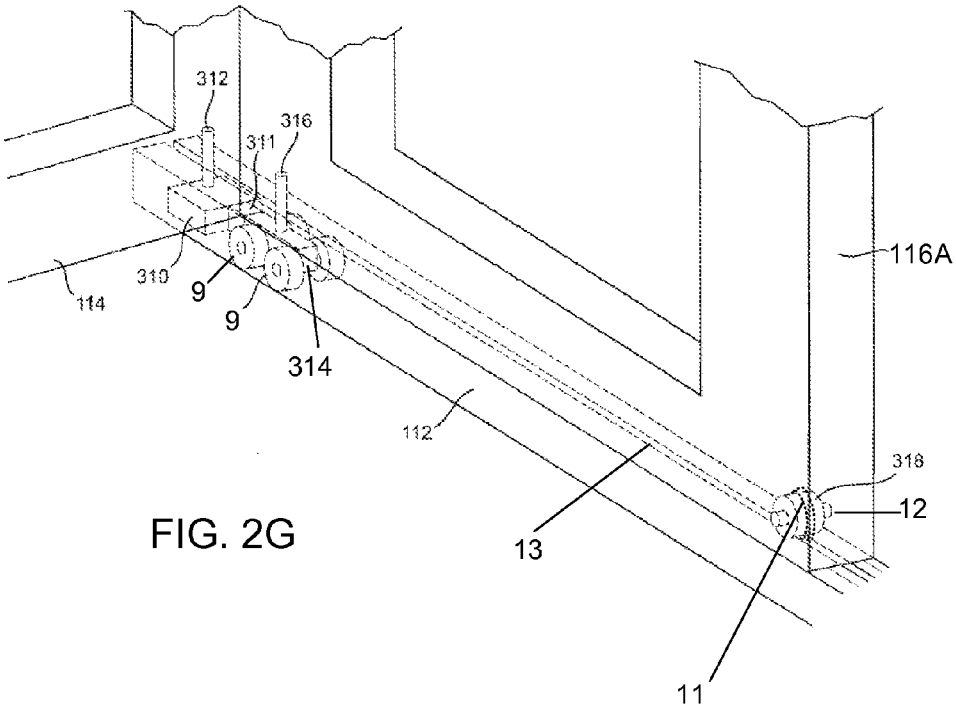

FIG. 2G shows a close up perspective view of the bottom of pivoting door 114, sliding door 116A and lower guide rail 112. As shown in FIG. 2G, lower pivot hinge 312 extends upward from bottom stationary anchor 310 Likewise, lower pivot hinge 316 extends upward from lower bogie 314. Lower bogie 314 is supported by wheels 9. Wheels 9 are configured to roll inside lower guide rail 112, thereby allowing sliding door 116A to slide leftward and rightward.

Lower guide rail 112 has a cross section that is fabricated in the general shape of a "u" with flanges pointing inward toward the center and a grove running down the middle so lower pivot hinge 316 can run horizontally within the lower guide rail 112. Lower bogie 314 is constructed similar to upper bogie 214.

Roller 318 is attached to sliding door 116A via axis 12. Roller 318 includes center extension 11 that fits into groove 13 of lower guide rail 112. Roller 318 is wider than the groove 13 and rides on the top of lower guide rail 112. Preferably, roller 318 is made from a heavy duty convex nylon. Roller 318 is attached to sliding door 116A in such a way as to enable sliding door 116A to be slid horizontally left or right while keeping sliding door 116A square in the closure. Center extension 11 holds sliding door 116A parallel to upper support track 110 and lower guide rail 112 while sliding door 116A is being slid leftward or rightward.

Fulcrum

Figure 2H:
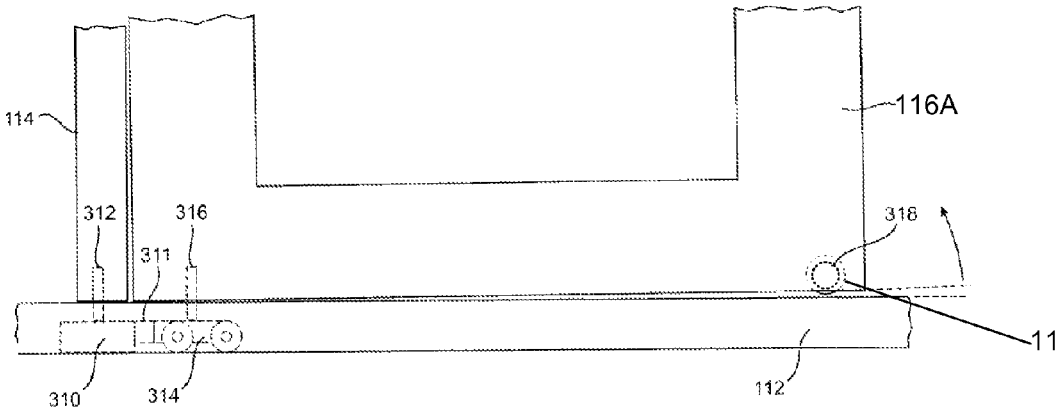
FIG. 2H shows the operation of the fulcrum.

As shown in FIGS. 2G and 2H, fulcrum 311 is rigidly connected to stationary bottom anchor 310 so as to stop lower bogie 314 just before stationary door magnet 212 and sliding door magnet 218 are drawn together via magnetic force. Fulcrum 311 is installed in such a way as to work in unison with stationary door magnet 212 and sliding door magnet 218 and lower bogie 314 to tilt sliding door 116A so as to lift center extension 11 clear of groove 13 of lower guide track 112 (see also FIG. 2H).

Figure 3A:
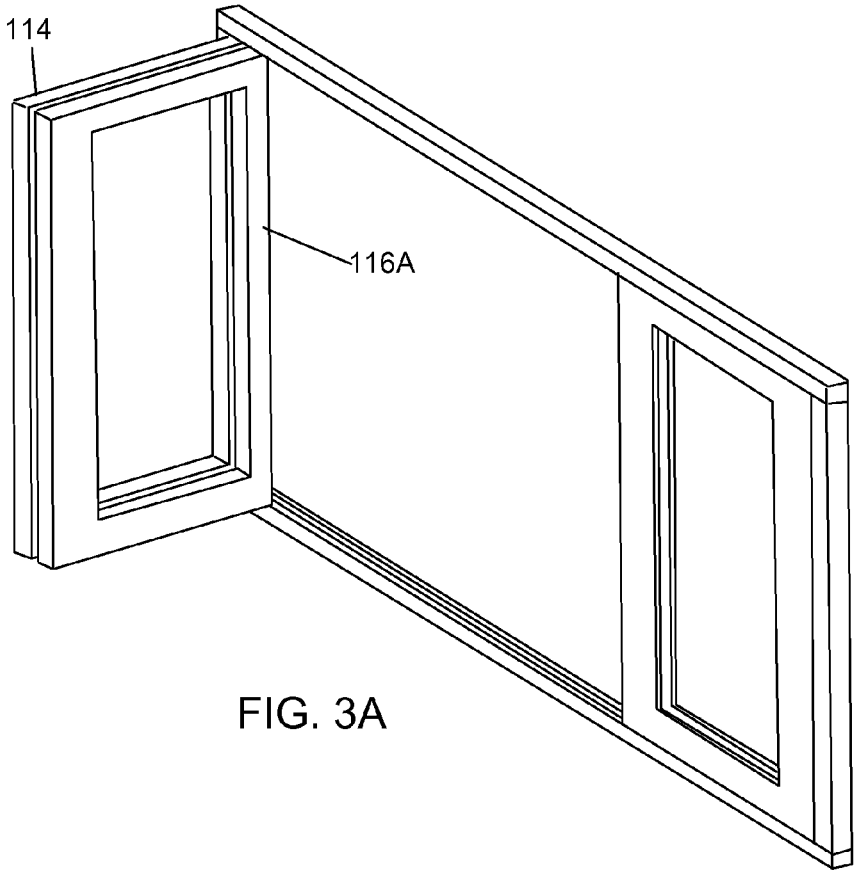
FIGS. 3A-3B show the first sliding door opened.
Figure 3B:
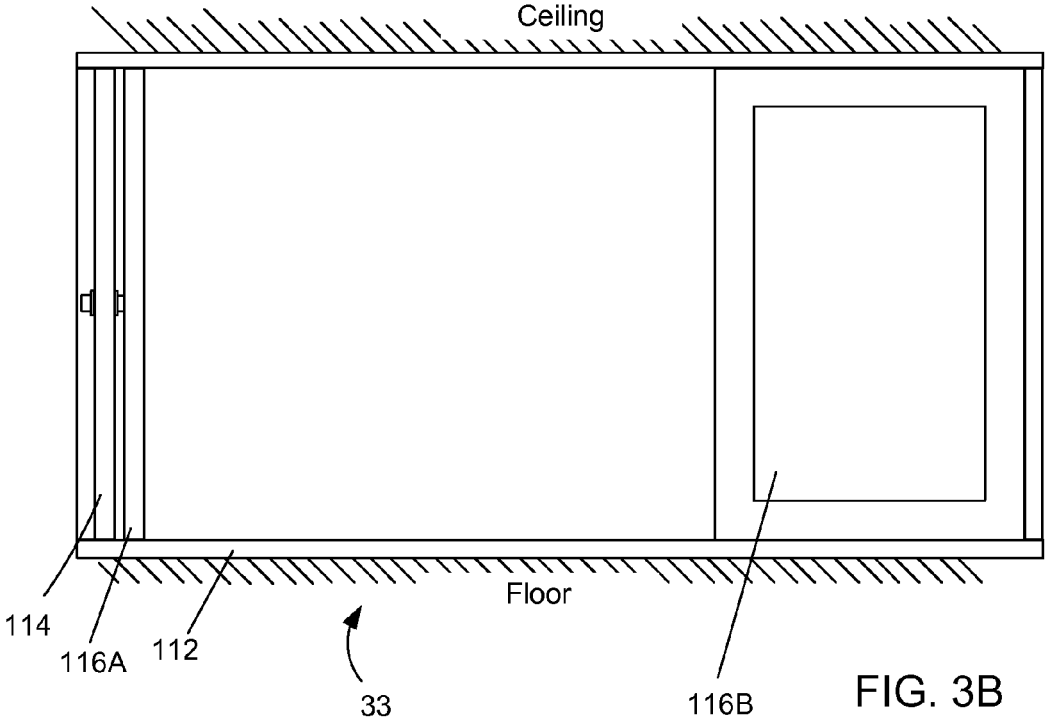

As shown in FIGS. 3A and 3B, because extension 11 is clear of groove 13 (FIG. 2H), the user is able to pull on sliding door 116A causing it to pivot about the axis formed by upper pivot hinge 216 (FIG. 2F) and lower pivot hinge 316 (FIG. 2G).

Figure 3C:
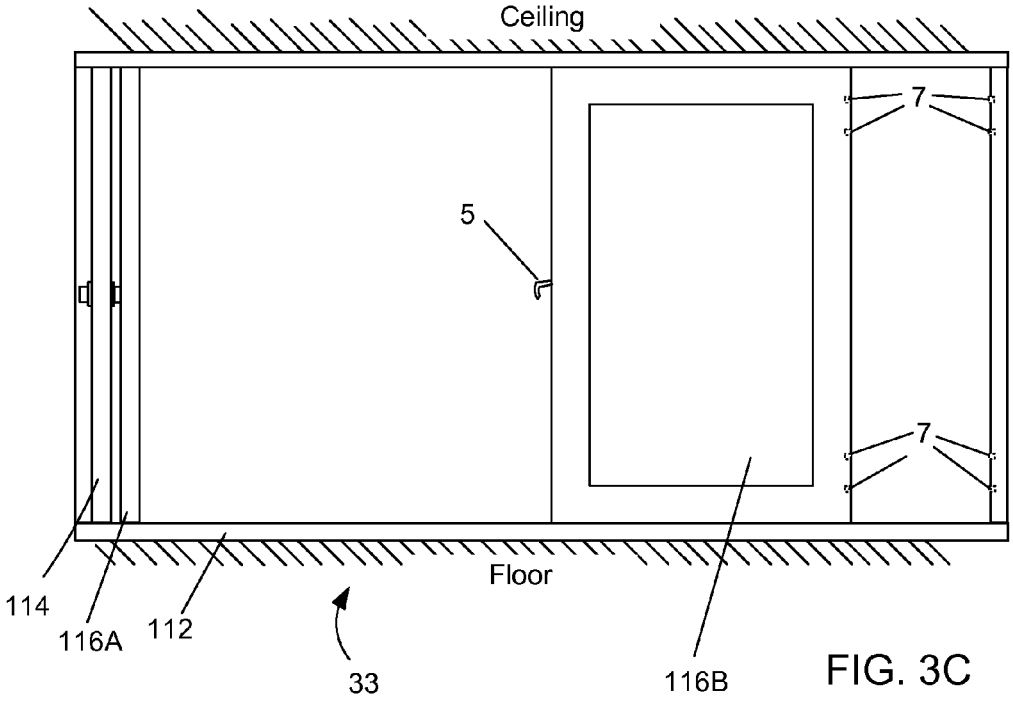
FIGS. 3C-3E show the second sliding door moving towards the first sliding door.

In FIG. 3C the user has grabbed retractable handle 5 of sliding door 116B overcoming the magnetic attractive force of magnets 7.

Figure 3D:
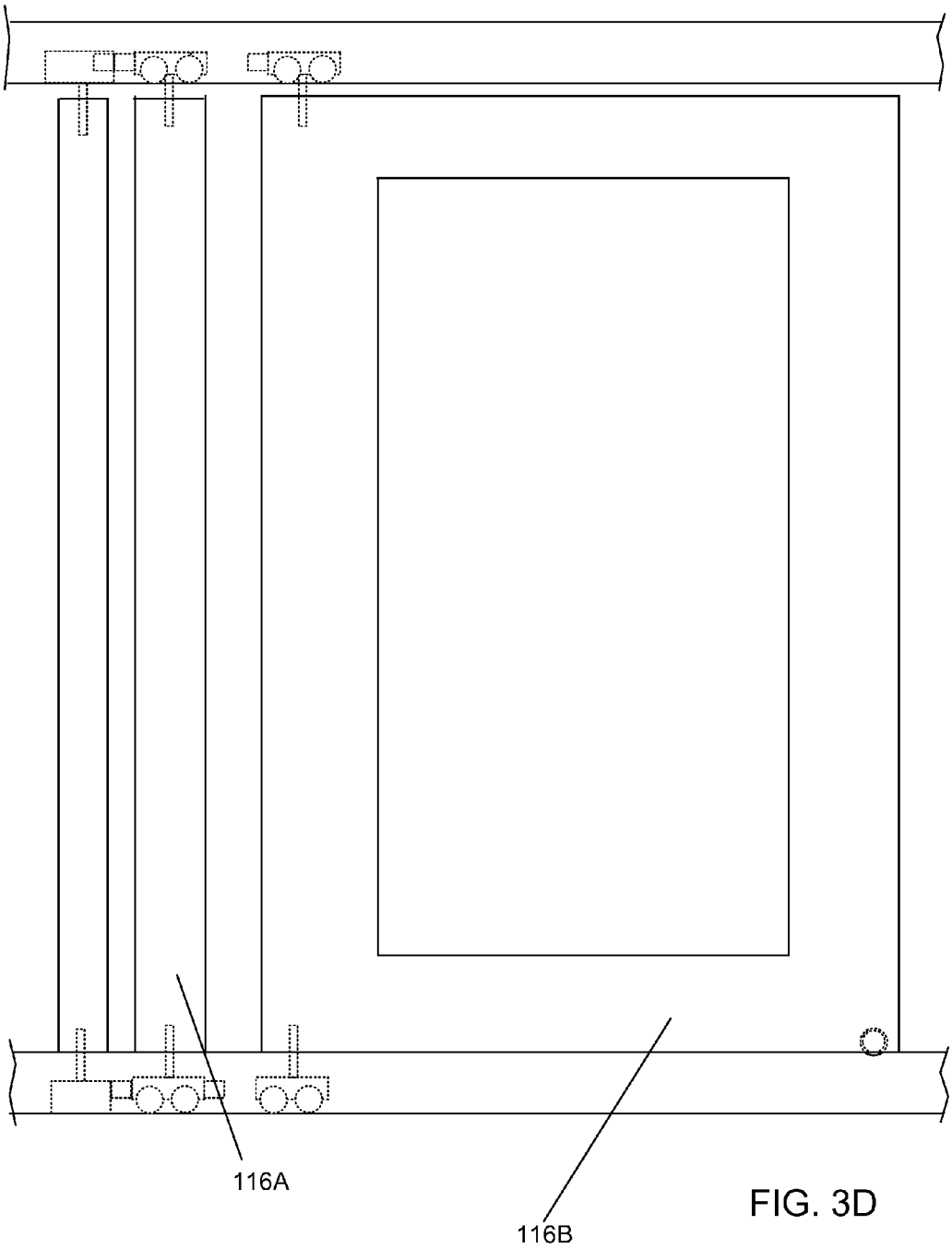

In FIG. 3D, the user has pulled sliding door 116B so that it is very close to opened sliding door 116A. Extension 11 is inside groove 13 (FIG. 2G) of lower guide track 112.

Figure 3E:
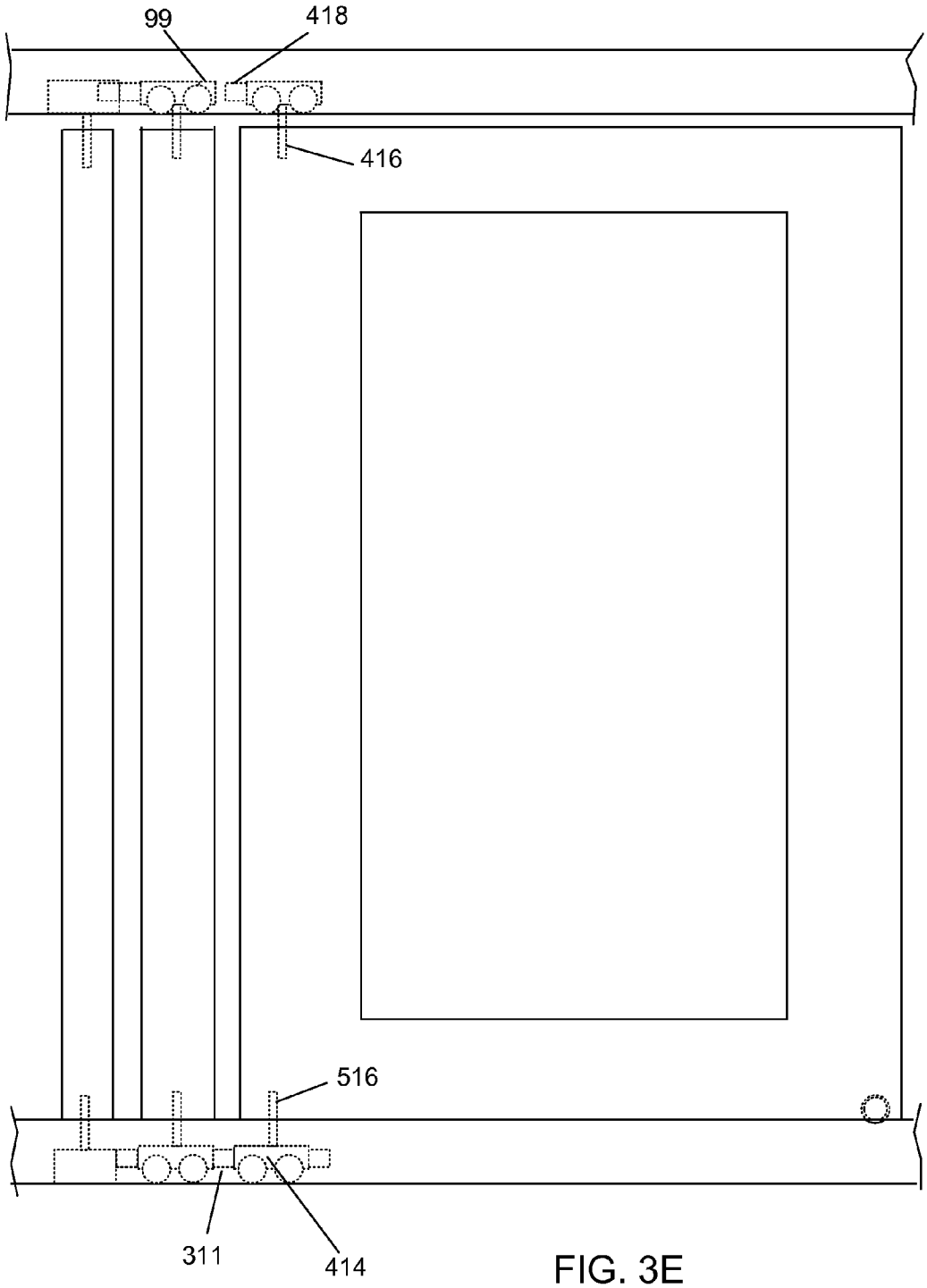

In FIG. 3E, lower bogie 414 has made contact with fulcrum 311. Inside upper support track 110 magnet 418 has not made contact with magnet 99. However, the magnets are of sufficient strength and distance so that a magnetic force is drawing them together.

Figure 3F:
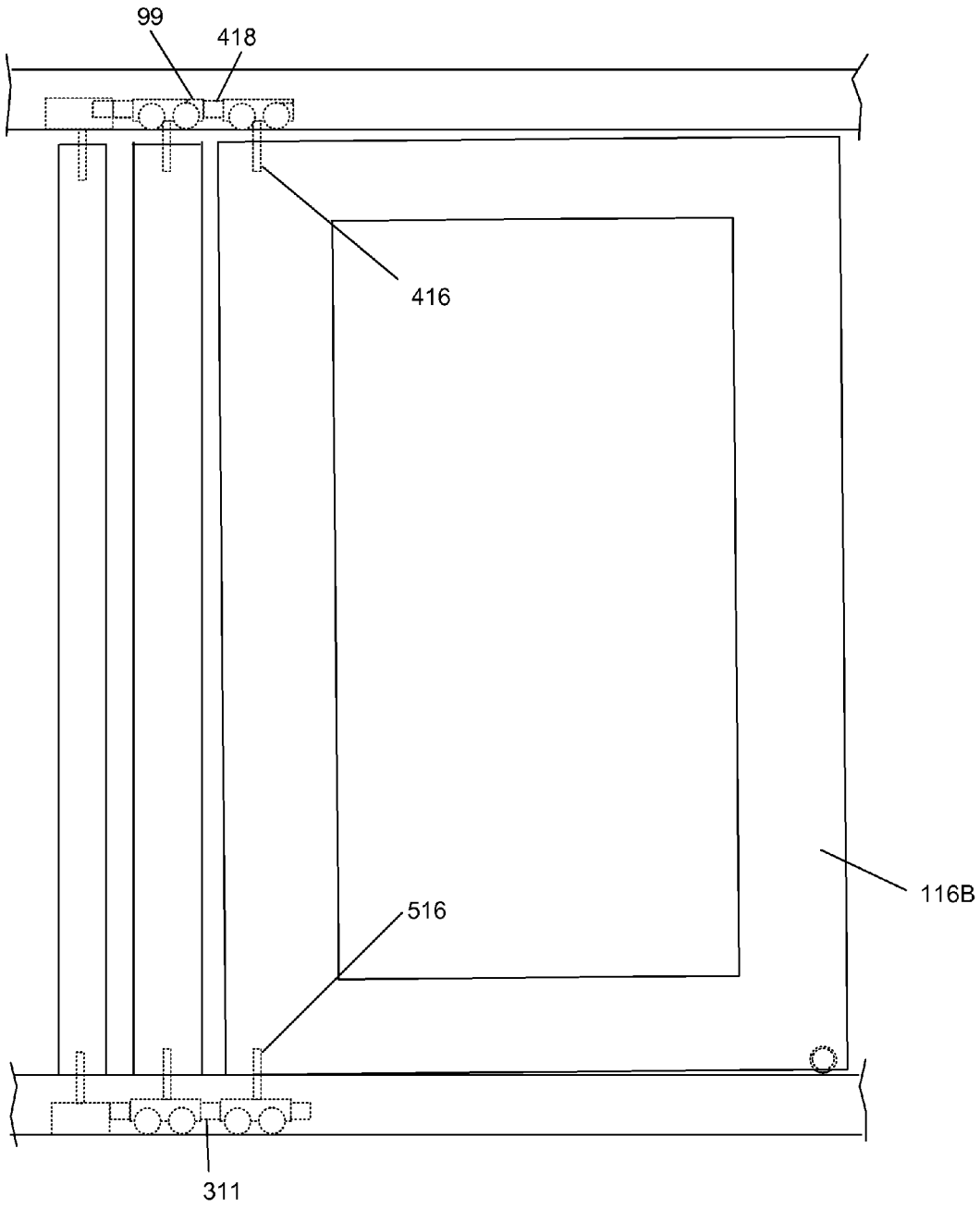
FIG. 3F shows the operation of the fulcrum on the second sliding door.
Figure 3G:
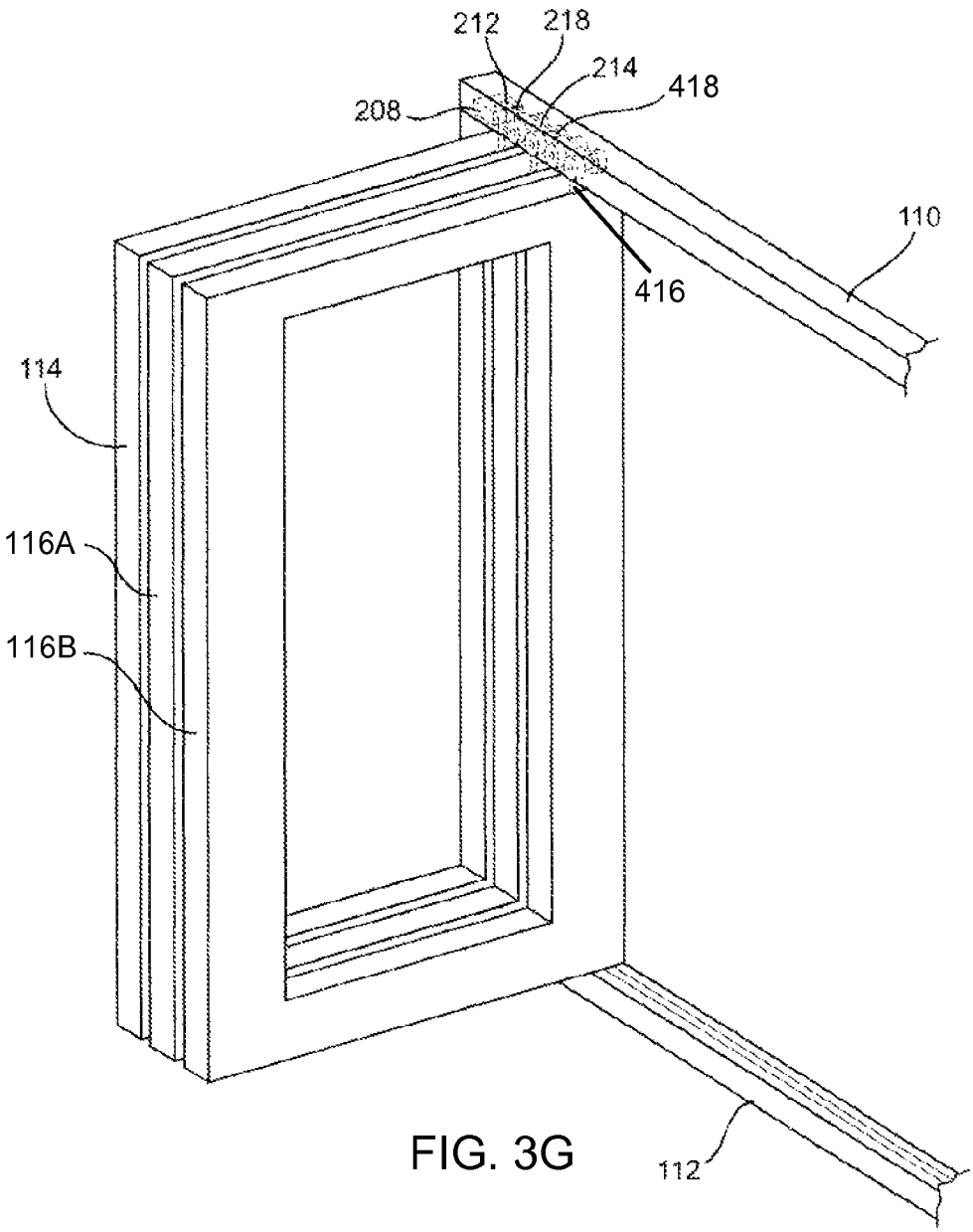
FIGS. 3G-3H show the second sliding door opened.
Figure 3H:
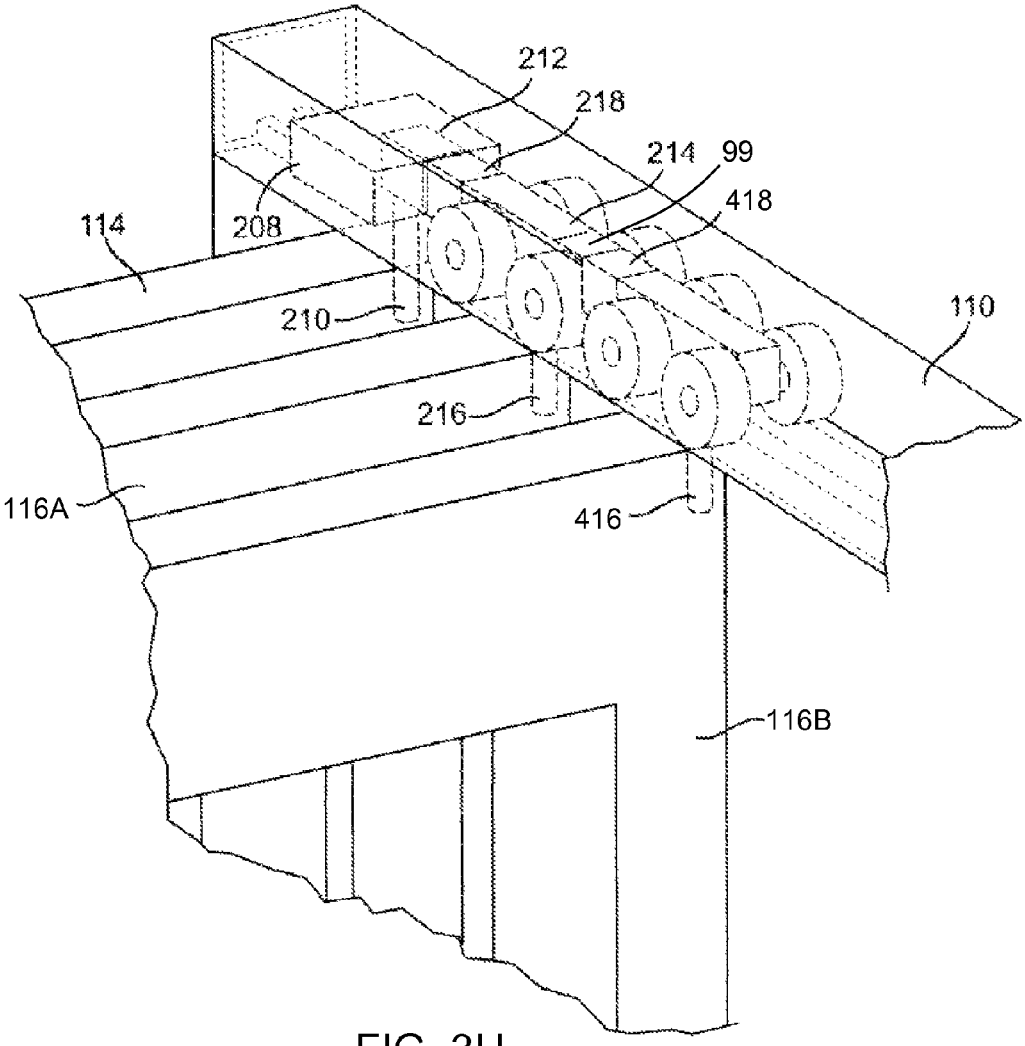

In FIG. 3F, magnetic force has drawn magnet 418 and magnet 99 together. Fulcrum 311 has caused sliding door 116B to pivot as shown so that extension 11 has cleared groove 13 (FIG. 2G) of lower track guide 112. Now the user may easily open sliding door 116B so that it can pivot about the axis formed by upper pivot hinge 416 and lower pivot hinge 516, as shown in FIGS. 3G and 3H.

Other Preferred Embodiments

Multiple Sliding Doors

Figure 4:
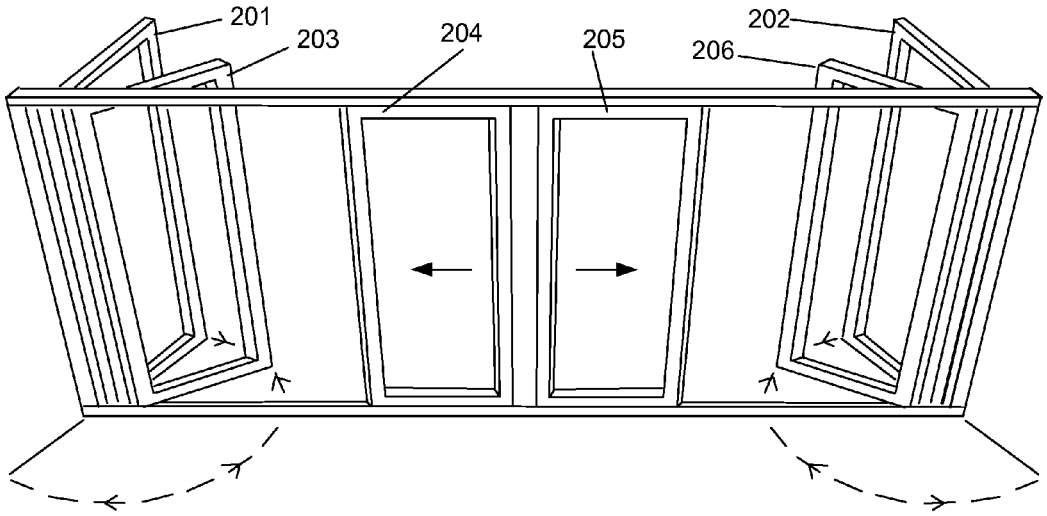
FIG. 4 shows another preferred embodiment of the present invention.

The above described preferred embodiment showed a preferred embodiment having one pivoting door 114 and two sliding doors 116A and 116B. It is possible to modify the present invention to include as many sliding doors as desired and to include another stationary door if desired. For example, FIG. 4 shows sliding door structure 34 having stationary doors 201 and 202. Sliding door structure 34 also has four sliding doors 203, 204, 205 and 206. Doors 203 and 204 are configured to slide to the left and doors 205 and 206 are configured to slide to the right.

Windows

Figure 5:
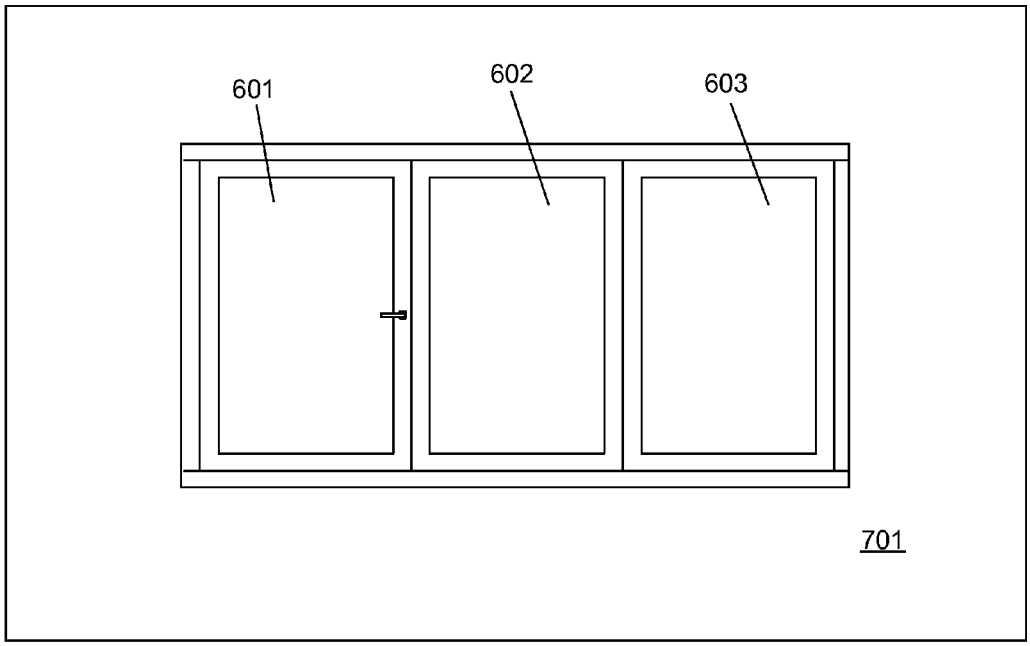
FIGS. 5-6 show another preferred embodiment of the present invention.

Although the above preferred embodiments described the present invention as being utilized for doors, it is also possible to utilize the present invention for other panel devices. For example, FIG. 5 shows the utilization of the present invention for windows. FIG. 5 shows stationary window 601 and sliding windows 602 and 603 mounted onto wall 701.

Figure 6:
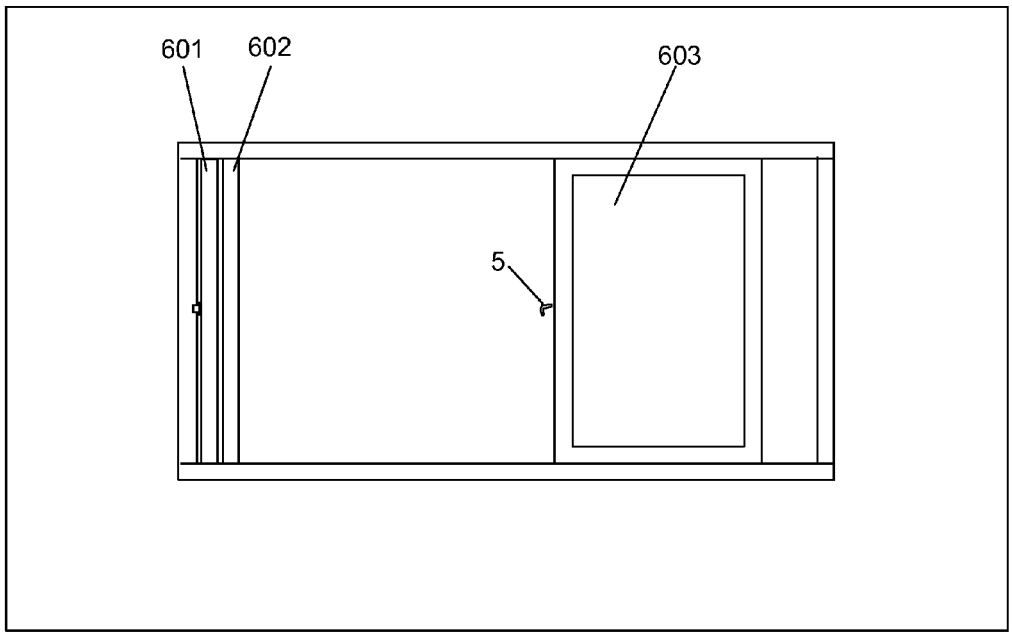

In FIG. 6, the user has opened stationary window 601 and sliding window 602 in a fashion similar to that described above. The user has grabbed retractable handle 5 and is pulling sliding window 603 leftward. If the user desires, he can also open sliding window 603 by utilization of a fulcrum in a fashion similar to that described above.

Although the above-preferred embodiments have been described with specificity, persons skilled in this art will recognize that many changes to the specific embodiments disclosed above could be made without departing from the spirit of the invention. For example, although the above preferred embodiments specifically disclose the utilization of magnetic force to attract the upper bogie to the upper anchor, it should be understood that a variety of other mutual attraction devices could also be utilized. For example, some of these include a rotating cam, a plethora of gears, a winged apparatus, a hook and latching pin, and a hollow cam and a solid cam that pivot and interlock. Also, although the above described preferred embodiments disclosed extension 11 attached to roller 318, it is possible to utilize other extension types. For example any extension shape will work so long as it is able to clear grove 13 when the sliding door is tilted by the fulcrum. Also, although it was shown that upper bogie 214 and lower bogie 314 utilized wheels 9 for rolling, it is possible to omit the wheels and utilize bogies that slide within the upper support track and lower guide rail. Therefore, the attached claims and their legal equivalents should determine the scope of the invention.

What is claimed is:

1. A sliding panel structure, comprising:

A) a plurality of sliding panels, each panel defining top edge and a bottom edge, and a first vertical edge and a second vertical edge on opposite sides of the panel, and each sliding panel adapted to slide horizontally leftward and rightward and pivot about a panel pivot axis located near the first vertical edge, with each of said plurality of sliding panels comprising a top cylindrical pivot space in the top edge near the first vertical edge and a bottom cylindrical pivot space in the bottom edge near the first vertical edge and aligned with the top cylindrical pivot space, said top and bottom cylindrical pivot spaces defining the panel pivot axis, B) an upper support track having an upside down U shaped cross section with two flanges at the bottom of the support track on each of two sides of the upper support track extending toward each other and defining an upper guide space between the two flanges, C) a plurality of upper support carts, each upper support cart defining an upper bogie, each of said upper bogies:

1) being adapted to move along said upper support track and provide upper guidance for a respective one of the panels, 2) having a support hinge element extending downward from the bogie through the upper guide space of the upper support track and into the upper pivot space of the respective one of the sliding panels to provide an upper hinge for the sliding panel, and 3) comprising a magnetic element adapted to cause a magnetic attraction between the upper bogie and a magnetic element of another upper bogie when the panel is to be pivoted to an open position and the two carts are close to each other, D) a lower guide rail, having an upright U shaped cross section with two flanges at or near the top of the lower rail guide extending toward each other to define a groove running down the middle of the lower guide rail, E) a plurality of lower support carts, each lower wheeled support carts defining a lower bogie, with each of the lower bogies:

1) being adapted to support a respective one of the sliding panels and roll along the lower guide rail and 2) having a support hinge element extending through the groove running down the middle of the lower guide rail and into a lower pivot space of the respective one of the sliding panels to provide a lower hinge for the sliding panel, said upper and lower hinges for each siding panel being adapted to permit the panels to be pivoted at least 90 degrees about the pivot axis, F) a plurality of panel roller elements each panel roller elements being 1) located near the bottom edge and the second vertical edge of a respective one of the plurality of sliding panels so as to roll on the two flanges of the lower rail guide to provide rolling support for the respective on of the plurality of sliding panels when it is being moved between an open position and a closed position, each of the panel roller elements having a maximum width wider than the groove running down the middle of the lower guide rail and 2) an extension element that is more narrow than the groove and adapted to extend through the groove when the panel is being supported by the roller element on the two flanges of the lower rail guard so as to permit the panel to be easily guided along the guide rail, wherein the upper support track and lower guide rail limit ranges of motion of the upper and lower bogies such that when each of the panels are in a process of being slid toward an opened direction, the range of the lower bogie is curtailed before the range of the upper bogie is curtailed so that when the lower range is curtailed the mutual attraction between the magnetic element of the upper bogie and the magnetic element of another upper bogie will apply a magnetic force sufficient to tilt the panel about a fulcrum position located at the bottom of the first vertical edge of the panel such that the extension element of the panel roller element will clear the groove running down the middle of the lower guide rail so as to permit the panel to be pivoted about the panel pivot axis to an open position.

2. The sliding panel structure as in claim 1, wherein said plurality of sliding panels is a plurality of sliding doors.

3. The sliding panel structure as in claim 1 wherein said plurality of sliding panels is a plurality of sliding windows.

4. The sliding panel structure as in claim 1, further comprising at least one non-sliding panel pivotally connected between said upper support track and said lower guide rail.

5. The sliding panel structure as in claim 1 wherein the plurality of upper support carts is a plurality of wheeled upper support carts.

6. The sliding panel structure as in claim 1 wherein the plurality of lower support carts is a plurality of wheeled lower support carts.

7. The sliding panel structure as in claim 1 wherein the sliding panel structure also comprises a stationary door structure in addition to the plurality of sliding panels and the stationary door is adapted to pivot about two pivot hinge elements, one of which is attached to a stationary upper anchor that comprises a magnetic element adapted to provide a magnetic attraction between the stationary anchor and a magnetic element of the upper bogie of one of the sliding panels.

* * * * *